US009604487B2

(12) United States Patent
Kozlowski

(10) Patent No.: US 9,604,487 B2
(45) Date of Patent: Mar. 28, 2017

(54) RECORDING MATERIAL FOR THERMAL PRINTING METHODS

(71) Applicant: Schoeller Technocell GmbH & Co. KG, Osnabrück (DE)

(72) Inventor: Christoph Kozlowski, Osnabrück (DE)

(73) Assignee: Schoeller Technocell GmbH and Co. KG, Osnabrück (DE)

( * ) Notice: Subject to any disclaimer, the term of this patent is extended or adjusted under 35 U.S.C. 154(b) by 0 days.

(21) Appl. No.: 14/945,633

(22) Filed: Nov. 19, 2015

(65) Prior Publication Data

US 2016/0159126 A1 Jun. 9, 2016

(30) Foreign Application Priority Data

Dec. 5, 2014 (EP) ..... 14196562

(51) Int. Cl.

| | |
|---|---|
| ***B41M 5/42*** | (2006.01) |
| ***B41M 5/44*** | (2006.01) |
| ***B41M 5/50*** | (2006.01) |
| ***B41M 5/52*** | (2006.01) |

(52) U.S. Cl.

CPC ..... *B41M 5/44* (2013.01); *B41M 5/42* (2013.01); *B41M 5/423* (2013.01); *B41M 5/506* (2013.01); *B41M 5/5218* (2013.01); *B41M 2205/02* (2013.01); *B41M 2205/32* (2013.01); *B41M 2205/38* (2013.01)

(58) Field of Classification Search

CPC ..... B41M 5/42; B41M 5/423; B41M 5/44; B41M 5/50; B41M 5/506; B41M 2205/02; B41M 2205/32; B41M 2205/38

USPC ..... 503/227

See application file for complete search history.

(56) References Cited

U.S. PATENT DOCUMENTS

2007/0148378 A1 6/2007 Koide et al.

FOREIGN PATENT DOCUMENTS

| | | |
|---|---|---|
| WO | 98/10939 | 3/1998 |
| WO | 2011/078406 | 6/2011 |

*Primary Examiner* — Bruce H Hess

(74) *Attorney, Agent, or Firm* — Honigman Miller Schwartz and Cohn LLP; Thomas A. Woolton; Jonathon P. O'Brien

(57) ABSTRACT

A recording material for thermal printing methods comprising a carrier and a dye-absorbing layer equipped for the thermal dye transfer, wherein a barrier layer is arranged between the carrier and the dye-absorbing layer and the barrier layer contains gelatine and a polymer binder dispersible in water, the gelatine and the polymer binder dispersible in water being cross-linked with one another, suitable for the production of photo-like images having very good dye migration behavior and without mottle effect.

13 Claims, No Drawings

RECORDING MATERIAL FOR THERMAL PRINTING METHODS

CROSS REFERENCE TO RELATED APPLICATION

This application claims priority under 35 U.S.C. §119 to and benefit of European Application No. EP 14196562.4, filed Dec. 5, 2014, which is incorporated herein by reference in its entirety.

FIELD OF THE INVENTION

The invention relates to a recording material for producing images of photo quality using thermal printing methods, in particular using a dye transfer method.

BACKGROUND OF THE INVENTION

The method of thermal dye transfer (TT) is used to reproduce a digitally produced image in the form of a printed image, of which the image quality is matched to the level of silver salt photography. The digital image is processed point by point in terms of the basic colours cyan, magenta, yellow and black and is converted into corresponding electric signals, which are then converted into heat by means of the thermal head of a printer. Due to the influence of heat, the dye sublimates from the donor layer of a colour ribbon (colour sheet) in contact with the recording material to be printed and diffuses into the receiving layer of the recording material.

In order to achieve images of photo quality, a recording material requires good surface properties, low thermal conductivity, good heat resistance, high compressibility (softness), which is important in order to ensure good contact between the thermal head of the printer and the recording material, and good dimensional stability. In addition, the recording material must have good storage life after printing in order to prevent the migration of the dyes over time into and through the carrier and therefore in order to prevent the deterioration of the image quality.

Recording materials for thermal transfer printing have been described many times. They basically comprise a carrier, a dye-receiving layer, and optionally further functional layers. The requirements placed on the material can be optimised by suitable selection of the components of the recording material.

Uncoated or coated papers can be used as carrier, wherein synthetic-resin-coated papers, coated in particular with polyolefin, or papers provided with a multi-layered plastics film are particularly suitable. These carriers are described for example in EP 0 671 281 A1, EP 0 681 922 Al or EP 0 812 699 A1.

The dye-receiving layer contains a resin that has an affinity for the dye from the donor material. By way of example, plastics comprising ester compounds (such as polyester resins, polyacrylic acid ester resins, polycarbonate resins, polyvinyl acetate resins, styrene acrylate resins), plastics comprising amide compounds (such as polyamide resins), polyvinyl chloride and mixtures of the aforementioned resins can be used for this purpose. However, copolymers that as primary component contain at least one representative of the above-mentioned polymers, for example vinyl chloride/vinyl acetate copolymer, can also be used.

Further functional layer may comprise, by way of example, anti-curl layers in order to counteract the curvature of the recording material once passed through the thermal printer. By way of example, plastics films that are laminated onto the rear side of the recording material are well suited for this purpose.

The problem of compressibility can be solved by the application of an intermediate layer performing the function of a cushioning layer, as described in JP 02-274592 or JP 03-268998. The intermediate layer described in JP 04-21488 containing hollow microbeads may constitute an alternative approach. This intermediate layer additionally has an insulating effect and contributes to a reduction of the thermal conductivity.

WO 98/10939 A1 describes a recording material for thermal image recording having good temperature stability and low thermal conductivity as well as good compressibility. This object is achieved with the aid of a layer that consists of a gelatine derivatised with ethylenically unsaturated monomers, in particular a (meth)acrylated gelatine. A disadvantage of this recording material is the high application weight of this layer. This is because layer thicknesses from 20 to 100 μm are necessary in order to achieve the required low thermal conductivity. The problem of dye migration into the depth of the recording material, however, therefore still remains unsolved. A reduction of the dye migration may therefore be attained by curing the layer in an additional process step with the aid of a smooth cylinder.

SUMMARY OF THE INVENTION

The object of the invention is therefore to provide a recording material that has improved behaviour in terms of the dye migration whilst still meeting the other requirements placed on a recording material in thermal printing methods.

This object is achieved by a recording material for thermal printing methods having a carrier and a dye-absorbing layer equipped for the thermal dye transfer, wherein a barrier layer is arranged between the carrier and the dye-absorbing layer and the barrier layer contains gelatine and a polymer binder dispersible in water, wherein gelatine and the polymer binder dispersible in water are cross-linked with one another.

PREFERRED EMBODIMENTS OF THE INVENTION

The gelatine in the barrier layer is preferably a non-chemically modified on non-derivatised gelatine. A gelatine having an isoelectric point from 8 to 9, particularly preferably 8 to 8.5, may preferably be used in the barrier layer.

The polymer binder dispersible in water in the barrier layer is preferably a water-dispersible polyester/polyurethane copolymer.

In order to reduce the migration of hydrophobic dyes from the dye-absorbing layer, a hydrophilic barrier is required. Such a barrier may be a hydrophilic binder coating. A disadvantage, however, of such hydrophilic binder coatings is that what is known as a mottle effect, i.e. a cloudiness in the printed image, occurs during thermal printing in climates with high atmospheric humidity. It has surprisingly been found that a good barrier effect is attained when the barrier layer contains a binder mixture formed from gelatine and polyester/polyurethane copolymer. It is also surprising that the aforementioned mottle effect is avoided by this binder mixture following cross-linking. A barrier layer containing gelatine and polyester/polyurethane copolymer consequently allows not only the printing of images with structures having little or no mottle, but also a good to very good migration behaviour of the recording material.

The mass ratio of gelatine to the water-dispersible polymer binder in the barrier layer may preferably be 80:20 to 40:60, particularly preferably 60:40 to 50:50.

The polyester polyurethanes used in accordance with the invention are aliphatic polyester polyurethanes. They may be based on an aliphatic isocyanate having a 100% modulus of elasticity in accordance with DIN 53504 from 10 to 14 MPa, preferably 12 to 13 MPa. By way of example, they may have a melting range from 190 to 230° C., preferably 200 to 220° C., on the Kofler bench. Suitable polyester polyurethanes may be used in anionic form as dispersion. The solid proportion of the dispersion may be 20 to 45% by weight, preferably 28 to 40% by weight. Films formed from the polyester polyurethane used in accordance with the invention may have a microhardness in accordance with DIN 53504 of approximately 95° Shore A. The original tensile strength of such films in accordance with DIN 53504 may be approximately 40 MPa, and the original elongation at break in accordance with DIN 53504 may be approximately 400%. Such polyester polyurethanes are commercially obtainable in various types under the name NeoRez®.

The advantageous effect obtained in accordance with the invention with respect to the migration behaviour of the dye is obtained by a cross-linking of both binder types with the aid of a cross-linking agent. In principle, cross-linking agents that enable a cross-linking of a protein with a polyester polyurethane copolymer can be used for this purpose.

Suitable cross-linking agents are, for example, compounds containing imine groups or isocyanate groups. In a preferred embodiment of the invention the cross-linking of both binders may be obtained with a combination of at least two cross-linking agents. The first cross-linking agent may be a compound containing imine groups, and the second cross-linking agent may preferably be a compound comprising isocyanate groups. In this case the mass ratio of the cross-linking agent containing imine groups to the cross-linking agent containing isocyanate groups may be 6:1 to 1:1, for example.

The quantity of the cross-linking agent containing imine groups may be 5 to 15% by weight, in relation to the total mass of the binders.

The quantity of the cross-linking agent containing isocyanate groups in the barrier layer may be 2 to 15% by weight, in relation to the total quantity of the binders. The total quantity of the cross-linking agent used in accordance with the invention may be up to 40% by weight, in relation to the total mass of the binders. The cross-linking agent containing imine groups is preferably a polyaziridine. The cross-linking agent containing isocyanate groups is in particular a blocked isocyanate. The isocyanate may be blocked by an oxime that is cleaved under temperature effect. Due to the cross-linking, the gelatine is water-insoluble, and gelatine is also cross-linked with the binder dispersible in water.

In a further embodiment of the invention the barrier layer according to the invention may contain a pigment. Fine-grain pigments, which increase the opacity of the layer, are particularly preferred. Titanium dioxide is particularly well suited for this purpose. The pigment quantity may preferably be up to 30% by weight, but in particular 5 to 25% by weight, in relation to the mass of the dried layer.

The barrier layer according to the invention may optionally also contain further auxiliaries, for example anionic or non-ionic surface-active agents, dyes, brighteners, lubricants, anti-blocking agents and other conventional additives. The quantity of the auxiliaries may be 0.01 to 5.0% by weight, in particular 0.05 to 3.5% by weight, in relation to the mass of the dried layer.

In order to form the barrier layer as the coating compound according to the invention is produced, the binders dissolved or dispersed in water are mixed with one another in a first step. The pH value may be set to 7 to 7.5. The pigment dispersion is added and mixed in. In a second step the cross-linking agent is added. Following a subsequent mixing process, the coating compound produced in this way is applied to the carrier material.

In a preferred embodiment of the invention two cross-linking agents are added to the above-described dispersion, wherein the second cross-linking agent may be added at the same time as the first cross-linking agent is added or chronologically thereafter.

The coating compound for forming the barrier layer according to the invention may be applied in line or off-line using all application apparatuses conventional in paper production, wherein the quantities selected such that the application weight after drying is at most 3 g/m$^2$, in particular 0.5 to 2.5 g/m$^2$, or in accordance with a particularly preferred embodiment 1 to 2 g/m$^2$.

The carrier used in accordance with the invention may contain an uncoated or a coated base paper or may consist of such a base paper.

For the purposes of the invention the term "base paper" is understood to mean a mass-sized uncoated paper and/or a surface-sized paper. Besides pulp fibres, a base paper may also contain sizing agents such as alkyl ketene dimers, fatty acids and/or fatty acid salts, epoxidised fatty acid amides, alkenyl or alkyl succinic acid anhydride, wet strength agents such as polyamine-polyamide epichlorohydrin, dry strength agents such as anionic, cationic or amphoteric polyamides or cationic starches, optical brighteners, fillers, pigments, dyes, anti-foaming agents and further auxiliaries known in the paper industry. The base paper may be surface-sized. Sizing agents suitable for this purpose include, for example, polyvinyl alcohol or oxidised starch. The base paper may be produced on a Fourdrinier or a Yankee paper machine (cylinder paper machine). The weight per unit area of the base paper may be 50 to 250 g/m$^2$, in particular 80 to 180 g/m$^2$. The base paper may be used in uncompressed or compressed form (smoothed). Base papers having a density from 0.8 to 1.2 g/cm$^3$, in particular 0.90 to 1.1 g/cm$^3$, are particularly well suited. By way of example, bleached hardwood kraft pulp (LBKP), bleached coniferous kraft pulp (NBKP), bleached deciduous sulphite pulp (LBSP), or bleached coniferous sulphite pulp (NBSP) can be used as pulp fibres. Pulp fibres obtained from waste paper may also be used. The specified pulp fibres may also be mixed and proportions of other fibres, for example of synthetic resin fibres, can be admixed. However, pulp fibres formed from 100% deciduous pulp are preferably used. The mean fibre length of the unground pulp is preferably 0.5 to 0.85 mm (Kajaani measurement).

By way of example, kaolins, calcium carbonate in its natural forms, such as limestone, marble or dolomite brick, precipitated calcium carbonate, calcium sulphate, barium sulphate, titanium dioxide, talc, silica, aluminium oxide, and mixtures thereof may be used as filler in the base paper.

In a particular embodiment of the invention a pigment-containing layer may be arranged on the base paper. The pigment may be a metal oxide, silicate, carbonate, sulphide or sulphate. Pigments such as kaolins, talc, calcium carbonate and/or barium sulphate are particularly well suited. A calcium carbonate having a D50% value in the particle size of approximately 0.7 μm has proven to be particularly advantageous.

In a further embodiment of the invention the base paper or the coated base paper may be provided on both sides with synthetic resin layers. The synthetic resin layers (front-side and/or rear-side synthetic resin layer) may preferably contain a thermoplastic polymer. In particular, polyolefins, for example low-density polyethylene (LDPE), high-density polyethylene (HDPE), polypropylene, 4-methylpentene-1 and mixtures thereof and also polyesters, for example polycarbonates, are suitable for this purpose.

In a further particularly preferred embodiment of the invention the front-side and/or rear-side synthetic resin layer contains at least 40% by weight HDPE with a density of more than 0.95 g/cm$^3$, in particular 60 to 80% by weight. A composition that consists of 65% by weight HDPE with a density of more than 0.95 g/cm$^3$ and 35% by weight LDPE with a density of less than 0.935 g/cm$^3$ is particularly preferred.

The synthetic resin layers may contain white pigments, such as titanium dioxide, and also further auxiliaries, such as optical brighteners, dyes, and dispersing agents. In a particular embodiment of the invention anti-statically acting substances, in particular electrically conductive inorganic pigments, are added to the synthetic resin layers.

The application weight of the synthetic resin layers may be 5 to 50 g/m$^2$, in particular 5 to 30 g/m$^2$, but preferably 10 to 20 g/m$^2$. The synthetic resin layer may be extruded in one layer or co-extruded in a number of layers onto the base paper or the coated for paper. The extrusion coating may be performed at machine speeds up to 600 m/min.

In a preferred embodiment of the invention the carrier contains an uncoated or coated base paper provided with a plastics film, wherein the plastics film is laminated onto the side facing towards the barrier layer (front side). Here, a polymer layer, preferably a low-density polyethylene (LDPE), is extruded between the base paper and the plastic film. The thickness of the polyethylene layer is 6 to 15 g/m$^2$, in particular 6 to 10 g/m$^2$. The plastics film preferably has a multi-layered structure with a porous core layer and at least one pore-free surface layer. A biaxially oriented polypropylene film having a thickness from 30 to 60 μm, in particular 35 to 50 μm, and an opacity from 70 to 90%, measured in accordance with JIS-P-8148, is particularly well suited for this purpose.

In a further embodiment of the invention a mono-layered or multi-layered plastics film, in particular a biaxially oriented polypropylene film, may also be applied to the rear side.

In principle, any colour-receiving layer known from the prior art for thermal transfer methods is suitable as dye-absorbing layer. The layer used in accordance with the invention preferably contains a polymer selected from the group of polyesters, polyacrylic acid esters, polycarbonates, styrene acrylates, vinyl-homo copolymers and/or vinyl copolymers. In particular, vinyl polymers, such as polyvinyl chloride, vinyl chloride/acrylate copolymer, vinyl chloride/vinyl acetate copolymer and/or vinyl chloride/vinyl acetate/vinylidene chloride, are well suited in particular.

In a further embodiment of the invention the dye-absorbing layer may contain an inorganic and/or organic pigment. A fine-grain inorganic pigment, for example silicon dioxide, aluminium oxide, aluminium oxide hydrate, aluminium silicate, calcium carbonate, zinc oxide, tin oxide, antimony oxide, titanium dioxide, indium oxide, or a mixed oxide of these oxides, is particularly well suited. The pigments may be provided individually or as mixtures in the dye-absorbing layer. In a preferred embodiment of the invention fine-grain silicic acids, in particular a finely dispersed silicic acid doped with aluminium, are contained in the layer.

The quantity of the pigment in the dye-absorbing layer may be 10 to 90% by weight, in particular 30 to 70% by weight, in relation to the mass of the dried layer.

The fine-grain pigment may have a mean particle size from 10 nm to 2 μm.

The dye-absorbing layer may optionally also contain further additives, for example anionic or non-ionic surface-active agents, matting agents, dyes, cross-linking agents, lubricants, anti-blocking agents, and other conventional additives. The quantity of the additives may be 0.01 to 10% by weight, in particular 0.05 to 5% by weight, in relation to the mass of the dried layer.

The coating compound for forming the dye-absorbing layer may be applied inline or offline using all application apparatuses conventional in paper production, wherein the quantity is selected such that, after drying, the application weight is at most 5 g/m$^2$, in particular 0.1 to 3 g/m$^2$, or in accordance with a particularly preferred embodiment 0.3 to 1.0 g/m$^2$.

The coating compounds for forming the barrier layer and the dye-absorbing layer may be applied separately, i.e. the coating compound produced in order to form the barrier layer is applied first to the carrier material. In a next step the coating compound for forming the ink-absorbing layer is applied to the dried barrier layer and is dried.

The above-described coating compounds may also be applied however "wet-in-wet", for example using a multi-layered curtain coating apparatus.

The following examples serve to explain the invention further.

EXAMPLES

Example 1

Production of a Base Paper

A base paper A was produced from eucalyptus pulp. For grinding, the pulp was ground as an approximately 5% aqueous suspension (thick matter) with the aid of a refiner to a grinding degree of 36° SR. The concentration of the pulp fibres in the thin matter was 1% by weight, in relation to the mass of the pulp suspension. Additives were added to the thin matter, such as cationic starch in a quantity of 0.4% by weight, alkyl ketene dimer (AKD) as a neutral sizing agent in a quantity of 0.48% by weight, wet strength agent polyamine-polyamide epichlorohydrin resin (Kymene®) in a quantity of 0.36% by weight, and a natural $CaCO_3$ in a quantity of 10% by weight. The specified quantities relate to the pulp mass. The thin matter, of which the pH value was set to approximately 7.5, was brought from the headbox to the wire of the paper machine, whereupon the sheets were formed with dewatering of the web in the wire section of the paper machine. Further dewatering of the paper web to a water content of 60% by weight, in relation to the web weight, was performed in the press section of the paper machine. The further drying was performed in the drying section of the paper machine by means of heated drying cylinders. A base paper having a weight per unit area of 132 g/m$^2$ and a moisture of approximately 7% was produced.

The base paper was coated on the front side with a coating compound formed from a styrene acrylate binder, starch, and a pigment mixture formed from calcium carbonate and kaolin with an application weight of 15 g/m$^2$, and was dried and then smoothed using a calander. The paper produced in this way has on the front side a Bekk smoothness of 800 seconds, measured in accordance with DIN 53107.

The surface of the paper provided for printing (front side) was laminated, after irradiation with a corona discharge, with a three-layered biaxially oriented polypropylene film (HIPHANE BOPP, Hwaseung Industries Co. Ltd) in the extruder, wherein a film formed from a low-density polyethylene (LDPE) was extruded between the paper carrier material and the plastics film. The thickness of the adhesion-promoting polyethylene film was 8 g/m$^2$. The side (rear side) of the paper opposite the side to be printed was coated in the extruder with a polyethylene mixture formed from 30% by weight of a low-density polyethylene (LDPE, d=0.923 g/cm$^3$) and 70% by weight of a high-density polyethylene (HDPE, d=0.964 g/cm$^3$) with an application weight of 40 g/m$^2$. The cooling cylinder was selected such that the resultant surface of the rear side has a roughness of 0.9 μm, measured as Rz value in accordance with DIN 4768. The obtained carrier material was then coated on the side coated with the plastics film with coating compounds A1 to A6 according to the invention (no. 25 Meyer rod) and was dried for three minutes at 78° C. The application quantities of the coating compounds were selected here such that a dry application (barrier layer) of 1.6 g/m$^2$ was provided in each case.

In the next step the dye-absorbing coating compound B was applied to the barrier layers (no. 15 Meyer rod) and dried (2 minutes, 78° C.). The application quantity of the coating compound was selected here such that a dry application of 0.5 g/m$^2$ was provided. The composition of the coating compounds is specified hereinafter in Table 1.

TABLE 1

Coating compounds A1 to A6

| | Composition | | | | | |
|---|---|---|---|---|---|---|
| | A1 | A2 | A3 | A4 | A5 | A6 |
| desalinated water | 82.70 | 82.37 | 81.45 | 80.63 | 79.81 | 78.34 |
| Gelatine Imagel ® AP 71979, 290 Bloom, isoel. pt. = 8 Gelita AG | 5.80 | 5.80 | 3.63 | 3.63 | 0.73 | 0.73 |
| $NH_3$ solution, 5% | 1.20 | 1.20 | 0.75 | 0.75 | 0.15 | 0.15 |
| $TiO_2$ Ti-Pure RPS Vantage 71% in water, DuPont | 2.91 | 2.91 | 2.91 | 2.91 | 2.91 | 2.91 |
| Optical brightener Leucophor ® UO, 25% Archroma International | 1.30 | 1.30 | 1.30 | 1.30 | 1.30 | 1.30 |
| Polyester polyurethane PU coat DMP 105, 40% in water, Baumeister Chemicals & Consulting GmbH & Co. KG | 3.26 | 3.26 | 8.16 | 8.16 | 14.68 | 14.68 |
| wetting agent Capstone ® FS 30, 25% in water, DuPont | 0.07 | 0.07 | 0.07 | 0.07 | 0.07 | 0.07 |
| polyaziridine PZ-33, 50% in IPA Flevo Chemie B.V. | 2.76 | 2.76 | 1.73 | 1.73 | 0.35 | 0.35 |
| blocked polisocyanate, TexiCross ® Al45, 40% in water, Baumeister Chemicals & Consulting GmbH & Co. KG | — | 0.33 | — | 0.82 | — | 1.47 |

Coating Compound B (Dye-absorbing Layer)

31.70 g of a vinyl chloride/acrylate copolymer dispersion having a solids content of 56% by weight (PrintRite® DP 281.E, manufacturer Lubrizol) and 13.58 g of a vinyl chloride/vinyl acetate/vinylidene chloride dispersion having a solids content of 56% by weight (Vycar® 577 E, manufacturer Lubrizol) were mixed with 3.15 g of a 30% aqueous suspension of colloidal silicic acid (Ludox® AM X4931, manufacturer Grace), 0.95 g of polydimethylsiloxane (Tego-Glide® 482, manufacturer Evonik Industries), 0.25 g of an anti-foaming agent (Tego Foamex®, 825, manufacturer Evonik Industries), 0.08 g of a surface-active substance (Capstone FS 30, 25%, manufacturer DuPont), and 50.29 g of water.

Comparative Example 1

The coating compound C provided to form the barrier layer was applied first (no. 25 Meyer rod) to the front side of the carrier material used in Examples 1 to 6, which, after drying (3 minutes, 78° C.), was coated with the dye-absorbing coating compound B (no. 15 Meyer rod). The application of the barrier layer was 1.6 g/m$^2$ after drying. The application quantity of the coating compound B was selected here such that a dry application of 0.5 g/m$^2$ was provided.

Comparative Examples 2 to 5

In order to form the barrier layer, the coating compounds D (Comparative example 2), E (Comparative example 3), F (Comparative example 4) and G (Comparative example G) were used. The carrier material and the dye-absorbing coating compound were as in Examples 1 to 6. The compositions of the coating compounds C to G are specified below in Table 2.

TABLE 2

| Composition | C | D | E | F | G |
|---|---|---|---|---|---|
| desalinated water | 83.52 | 82.85 | 83.40 | 82.85 | 83.40 |
| Gelatine Imagel ® AP 71979, 290 Bloom, isoelectr. point = 8 Gelita AG- | 7.25 | 5.80 | 2.94 | 5.80 | 2.94 |
| $NH_3$ solution, 5% | 1.50 | 1.50 | 1.50 | 1.50 | 1.50 |
| $TiO_2$ Ti-Pure RPS Vantage 71% in water, DuPont | 2.91 | 2.91 | 2.91 | 2.91 | 2.91 |
| Optical brightener Leucophor ® UO, 25% Archroma International | 1.30 | 1.30 | 1.30 | 1.30 | 1.30 |
| acryl/methacrylic acid ester copolymer Thyon ® SF 10 46.5% in water, Ecronova Polym. GmbH | — | 2.81 | 7.02 | — | — |
| Polyester polyurethane NeoRez ® R 600, 33% in water, DSM Neoresins | — | — | — | 2.81 | 7.02 |
| wetting agent Capstone ® FS 30, 25% in water, DuPont | 0.07 | 0.07 | 0.07 | 0.07 | 0.07 |
| polyaziridine PZ-33, 50% in IPA Flevo Chemie B.V. | 3.45 | 2.76 | 0.86 | 2.76 | 0.86 |

The recording materials obtained in accordance with the examples and comparative examples were subjected to the tests described hereinafter.

Dye Migration Test

The patterns were printed using the maximum colour densities of yellow, cyan, magenta and black on the printer CP-D70DW from Mitsubishi with standard donor ribbon. The print format was 10×15 cm and the colour areas were 1×1 cm in size. These patterns were hung for 5 days at 80° C. oven temperature. After 5 days the dye penetration on the rear side of the printed pattern was assessed, more specifically by means of grading.

The assessment was performed as follows: no colour penetration on the rear side was assessed as grade 1, heavy and large-area colour penetration was assessed as grade 5. This included the relative gradation from grade 1 to grade 5.

Mottle Assessment (Cloudiness)

Patterns and printers CP-D70DW from Mitsubishi were pre-conditioned for 12 h at 40° C. and 80% relative atmospheric humidity. In the climate provided a 10×15 cm full-area black print was then performed. The mottle assessment of the patterns was performed using a grading from 1-5. The grade 1 meant no mottle and the grade 5 meant strong mottle. The gradation between 1-5 was relative to grades 1 and 5. The test results are summarised in the following Table 3.

TABLE 3

| Recording material | | Migration Grade | Migration Grade |
|---|---|---|---|
| A1 | Invention Example 1 | 1 | 2 |
| A2 | Invention Example 2 | 1 | 1 |
| A3 | Invention Example 3 | 2 | 2 |
| A4 | Invention Example 4 | 2 | 1.5 |
| A5 | Invention Example 5 | 5 | 1 |
| A6 | Invention Example 6 | 5 | 1 |
| C | Comp. example 1 | 1 | 4 |
| D | Comp. example 2 | 2 | 4 |
| E | Comp. example 3 | 3 | 3 |
| F | Comp. example 4 | 2.5 | 4 |
| G | Comp. example 5 | 4 | 3 |

It can be seen that the recording materials according to the invention after printing have a good to very good migration behaviour for the dyes and do not have any mottle effect. All tested recording materials according to the invention additionally present excellent colour density of the transferred image.

I claim:

1. A recording material for thermal printing methods comprising a carrier and a dye-absorbing layer equipped for the thermal dye transfer, characterised in that a barrier layer is arranged between the carrier and the dye-absorbing layer and the barrier layer contains gelatine and a polymer binder dispersible in water, the gelatine and the polymer binder dispersible in water being cross-linked with one another.

2. The recording material according to claim 1, characterised in that the binders cross-linked with one another are cross-linked by at least two different cross-linking agents.

3. The recording material according to claim 2, characterised in that the gelatine is a non-derivatised gelatine.

4. The recording material according to claim 3, characterised in that the water-dispersible polymer binder is a polyester polyurethane copolymer.

5. The recording material according to claim 4, characterised in that the mass ratio of gelatine to the binder dispersible in water is 80:20to 40:60.

6. The recording material according to claim 5, characterised in that the cross-linking agents are a compound containing imine groups and a compound containing isocyanate groups, wherein the mass ratio of both compounds is 1:1 to 6:1.

7. The recording material according to claim 6, characterised in that the cross-linking agent containing imine groups is a polyaziridine.

8. The recording material according to one of claim 7, characterised in that the cross-linking agent containing isocyanate groups is a blocked isocyanate.

9. The recording material according to claim 8, characterised in that the carrier material contains an uncoated base paper or a coated base paper and has a synthetic resin layer on the side facing towards the barrier layer.

10. The recording layer according to claim 9, characterised in that the synthetic resin layer is an extruded polyolefin layer or a laminated polymer film.

11. The recording layer according to claim 10, characterised in that the polymer film is a biaxially oriented polypropylene film having a porous core layer and at least one pore-free surface layer.

12. The recording material according to claim 11, characterised in that a polyethylene layer is arranged between the synthetic resin layer and the barrier layer.

13. The recording material according to claim 12, characterised in that the dye-absorbing layer contains polymer with affinity for the dyes of the donor material, a fine-grain inorganic pigment, and optionally further auxiliaries.

* * * * *